United States Patent [19]

Pargamin

[11] 4,267,403

[45] May 12, 1981

[54] ELECTRIC LINE INSULATOR MADE OF ORGANIC MATERIAL AND HAVING AN INNER SEMI-CONDUCTIVE PART EXTENDING BETWEEN END ANCHOR FITTINGS

[75] Inventor: Laurent Pargamin, Vichy, France

[73] Assignee: Ceraver, Paris, France

[21] Appl. No.: 961,163

[22] Filed: Nov. 16, 1978

[30] Foreign Application Priority Data

Dec. 14, 1977 [FR] France ..... 77 37652

[51] Int. Cl.[3] ..... H01B 17/42; H01B 17/02

[52] U.S. Cl. ..... 174/140 S; 174/179

[58] Field of Search ..... 174/140 C, 140 S, 176, 174/177, 178, 179, 209, 211

[56] References Cited

U.S. PATENT DOCUMENTS

| | | | |
|---|---|---|---|
| 2,732,423 | 1/1956 | Morrison | 174/209 |
| 3,325,584 | 6/1967 | Herzig | 174/179 X |
| 3,877,523 | 4/1975 | Ely | 174/177 X |
| 3,941,918 | 3/1976 | Nigol et al. | 174/140 C |
| 4,057,687 | 11/1977 | Willem | 174/179 |
| 4,107,455 | 8/1978 | Richards | 174/179 X |

FOREIGN PATENT DOCUMENTS

| | | | |
|---|---|---|---|
| 1921299 | 11/1970 | Fed. Rep. of Germany | 174/179 |
| 1932949 | 1/1971 | Fed. Rep. of Germany | 174/179 |
| 2006247 | 10/1971 | Fed. Rep. of Germany | 174/140 C |
| 2361204 | 6/1975 | Fed. Rep. of Germany | 174/140 S |
| 2650363 | 11/1977 | Fed. Rep. of Germany | 174/179 |
| 1434604 | 2/1966 | France | 174/179 |
| 637218 | 5/1950 | United Kingdom | 174/211 |
| 641040 | 8/1950 | United Kingdom | 174/211 |
| 1039193 | 8/1966 | United Kingdom | 174/211 |
| 1233310 | 5/1971 | United Kingdom | 174/179 |
| 1296038 | 11/1972 | United Kingdom | 174/179 |
| 1345566 | 1/1974 | United Kingdom | 174/179 |
| 1408671 | 10/1975 | United Kingdom | 174/177 |

*Primary Examiner*—Laramie E. Askin

*Attorney, Agent, or Firm*—Sughrue, Rothwell, Mion, Zinn and Macpeak

[57] ABSTRACT

The invention relates to line insulators made of organic material. Such an insulator comprises a bar (7) of high tensile strength, a protective sheath (8) made of an elastomer material, a plurality of fins (4) and an anchor fitting (2) at each end. In accordance with the invention, at least one inner part of the insulator is semiconductive along the whole length which separates the anchor fittings (2); this part may be constituted either by the sheath (8) itself or by the bar (7) and the bedding material in said fittings. Application, in particular, to line insulators intended for use in highly polluted zones.

3 Claims, 2 Drawing Figures

ELECTRIC LINE INSULATOR MADE OF ORGANIC MATERIAL AND HAVING AN INNER SEMI-CONDUCTIVE PART EXTENDING BETWEEN END ANCHOR FITTINGS

FIELD OF THE INVENTION

The present invention relates to electric line insulators made of organic materials.

BACKGROUND OF THE INVENTION

There are two categories of insulators made of organic materials, namely, firstly, line insulators, which are subjected to stresses which may be either tensile or embedded bending stresses, and secondly equipment insulators which are subjected to stresses which may be either compression or embedded bending stresses. With both these categories of insulators, it is always of prime importance to attenuate the surface arcing phenomenon which is frequently encountered with apparatus used in highly-polluted zones.

Indeed, as in known glass or porcelain insulators, the surface arcing phenomenon occurs in line or equipment insulators used in highly polluted zones. Such a phenomenon is related to a damp layer of conductive polluting substance on the surface of the insulator: the leakage current dries said layer in some high current density zones and conditions thus promote the generation of electric arcs which short-circuit the dry zones.

Depending on the type of insulator used, numerous solutions have been proposed to mitigate the surface arcing phenomenon. They are generally based on the principle of providing a semiconductor zone between two electrodes so as to modify the distribution of the electric field in such a way as to make it less favourable to the generation of surface arcs.

In the case of know inorganic insulators, it has been proposed to provide surface coatings of enamel containing oxides of iron, titanium or tin; these coatings provide better electronic conduction. In practice, there has often been a great difficulty in providing good-quality and durable bonding between the insulating material and the semiconductor material. It has also been proposed to provide outer casings impregnated with oxides of iron, titanium or tin, or casings impregnated with graphite powder or with carbon black, for line insulators made of organic material. This applies in particular for those which include a bar of glass fibres impregnated with epoxy resin, said bar being covered with a casing which includes fins and whose function is both to protect the bar and to lengthen the leakage path (such a bar providing high tensile strength together with light weight).

However, the proposed solutions, although technically interesting, remain very difficult to put into practice with insulators for outdoor use. Indeed, drawbacks are often due to an electrochemical corrosion phenomenon, in particular in contact with the electrodes.

Interesting solutions (e.g. French Pat. No. 2,292,318) have also been proposed for equipment insulators made of organic material and in particular for those constituted by a body of moulded resin (generally based on those constituted by a body of moulded resin (generally based on epoxy-cycloaliphatic resin)) with electrodes or metal end pieces at least partially sunk into the ends of said body. The electrodes or end pieces are electrically connected by a thin resistor rod incorporated in the insulating body or by conductive material impregnated in the resin so that a small heating current leaks across the insulator. Indeed, there have been proposed casings of the same type as those mentioned hereinabove, having semiconductor materials distributed throughout their mass or having parts whose central portions only are semiconductive.

However, although these solutions may be suitable for equipment insulators, they are not directly applicable to line insulators such as those to which the present invention relates, because of the absolute necessity for high tensile strength which can not be provided by a resin body with end pieces sunk therein following a design suitable for withstanding compression stresses.

The present invention aims to provide a line insulator whose constitution withstands the surface arcing phenomenon when used outdoors, while remaining simple in design and relatively easy to manufacture.

SUMMARY OF THE INVENTION

The present invention provides an electric line insulator made of organic material, said insulator comprising a bar of high tensile strength made of a composite material which comprises inorganic or organic fibres or threads bonded together by a hardening synthetic resin, a protective sheath made of an elastomer material fixed over the whole surface of the bar exept for the ends of said bar, anchor fittings in which the ends of said bar are embedded by means of a bedding material which directly surrounds said ends, and a plurality of bins made of an elastomer material fixed on the sheath, and wherein at least one of the inner parts of said insulator is semiconductive along the whole length which separates the anchor fittings.

The electric insulator according to the invention may also include at least one of the following characteristics.

According to a first variant, the semiconductive inner part is constituted by the protective sheath, while the fins which surround said sheath are made of an insulating elastomer which is impregnated to provide good resistance to erosion, said fins serving to lengthen the leakage path.

The sheath and the anchor fittings may be connected together by a semiconductor ring made of the same material as the sheath and fixed at each end of the sheath both to the end of the sheath and to the inner wall of the associated anchor fitting.

The semiconductor sheath may adhere along its whole length to the bar, and the semiconductor ring may adhere to the sheath and to the wall facing the anchor fitting, by adhesion resulting from a vulcanization treatment.

The elastomer which constitutes the protective sheath may be an elastomer impregnated to provide suitable conductivity with at least one compound of the group which comprises: a high-structure carbon black, graphite powder of suitable granulometry, or an oxide of iron, titanium or tin.

According to another variant, the semiconductive inner part is constituted by the bar and the bedding material in contact with each end of said bar and the inner surface facing the associated anchor fitting, while the sheath surrounding said bar is made of an insulating elastomer.

The bar may then be constituted, at least partially, by conductive carbon fibres of very high tensile strength, bonded together with an epoxy or polyster resin.

The bedding material may be impregnated with high-structure carbon black which provides excellent electric contact between the bar and the anchor fittings.

Other characteristics and advantages of the invention will become more clearly apparent from the following description, given by way of example with reference to the figures of the single sheet of drawings in which:

DESCRIPTION OF THE PREFERRED EMBODIMENTS

Figure 1:
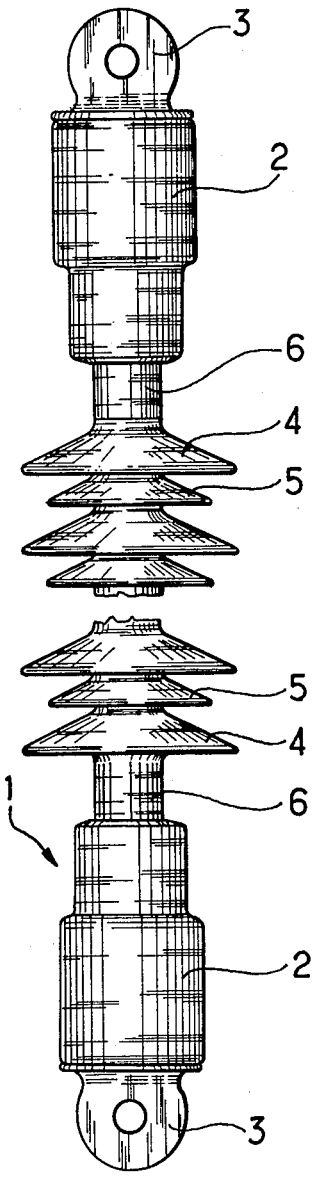
FIG. 1 is a partial elevation of a line insulator in accordance with the invention.

As shown in FIG. 1, a line insulator 1 in accordance with the invention and seen from the exterior has two metal anchor fittings 2 with fixing rings 3, between which are disposed a plurality of fins 4 and 5 made of an elastomer material with an elastomer insulating connection piece 6 in the proximity of said anchor fittings, so that no point of the internal sheath and, a fortiori, of the internal strength member or bar, is directly exposed to damage from the outside.

Figure 2:
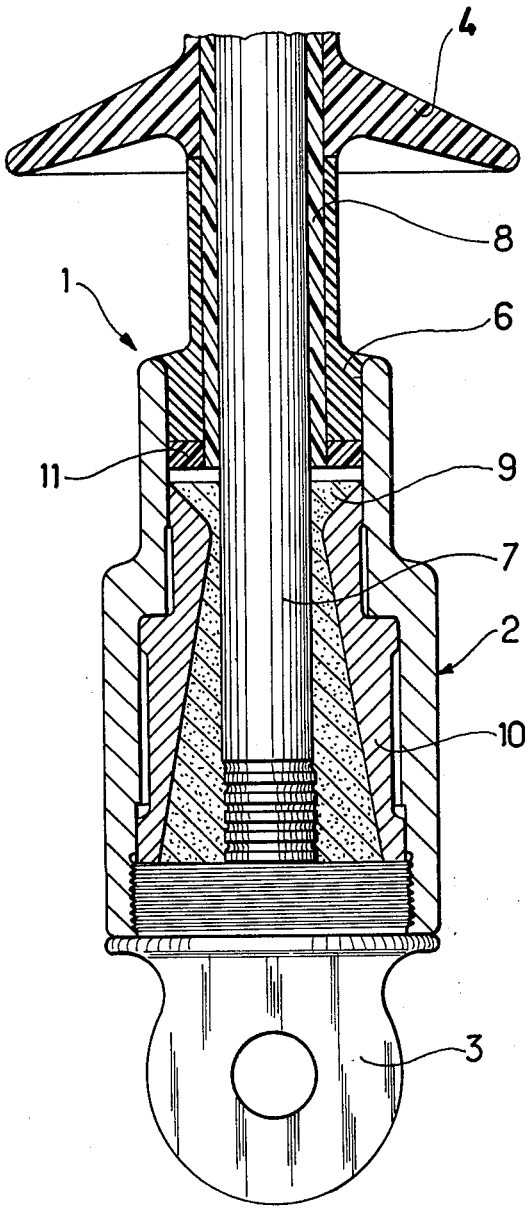
FIG. 2 is an axial cross-section on an enlarged scale of one end of the insulator shown in FIG. 1.

FIG. 2 shows the bar 7 which has high tensile strength. It is made of a composite material comprising inorganic or organic fibres or threads bonded together by a synthetic hardening resin: for example the fibres are glass fibres and they are impregnated with epoxy or polyester resin. The insulator also includes an internal protective sheath 8 made of an elastomer material, fixed on the whole surface of the bar 7 except on the ends thereof which are embedded in the anchor fittings 2 by means of bedding material 9 which directly surrounds said ends. The British Pat. No. 1,513,477 and corresponding U.S. Pat. No. 4,057,687 discuss at great length the properties of and a method of obtaining the biconical shape of the bedding material and of the bedding recess 10 of the anchor fitting. Lastly, the insulator includes a plurality of fins made of an elastomer material, fixed on the sheath 8. (Only the last one 4 is shown here).

In accordance with the invention, at least an inner part of the insulator is semiconductive along the whole length which separates the anchor fittings: therefore, said inner part remains completely protected from contact with electrolytes; this obviates the disadvantages due to electrochemical corrosion, in particular in contact with the electrodes, and provides suitable distribution of the electric field.

In accordance with a first variant, the semiconductive inner part comprises the protective sheath (8), while the fins (4, 5) which surround said sheath for lengthening the leakage path are made of an insulating elastomer which is impregnated and to provide good resistance to erosion. The sheath and the anchor fittings are connected together by a semiconductor ring (11) made of the same material as the sheath and fixeds both to each end of the sheath and to the adjacent inner wall of the associated anchor fitting.

In accordance with a preferred embodiment, the sheath 8 is extruded at about 120° C. on the treated bar 7 and covered with a conventional primer and is then vulcanized; the moulded semiconductor ring which is moulded and fitted onto the sheath is positioned relative to the bedding material 9 and is then vulcanized simultaneously on the sheath and on the wall facing the anchor fitting. Lastly, the fins 4, 5 fitted end to end with their interfaces applied against one another are assembled by vulcanization on the sheath. These various vulcanization treatments provide very great adhesion (sometimes denoted by the term adherence). The last operation is the anchoring of the ends of the bar in accordance with the above-mentioned British Pat. No. 1,513,477 or U.S. Pat. No. 4,057,687, followed by moulding and vulcanizing the connection pieces 6 so that they will have adequate adhesion on the sheath and on the facing surface of the anchor fitting.

The elastomer which constitutes the protective sheath 8 is preferentially an elastomer impregnated with at least one powdered compound, to provide suitable conductivity. Suitable powders include: a high-structure carbon black; graphite powder of suitable granulometry; and oxides of iron, titanium or tin.

In accordance with another variant, the semiconductive inner part comprises the bar (7) and the bedding material in contact with each end of the bar and the inner surface facing the associated anchor fitting, the sheath 8 surrounding said bar being made of an insulating elastomer. In this case, it would be possible to dispense with the semiconductor ring 11.

The bar is then advantageously constituted at least partially by conductive carbon fibres of very high tensile strength and bonded together by an epoxy or a polyester resin. The bedding material is impregnated with high-structure carbon black which provides excellent contact between the bar and the anchor fittings.

An insulator in accordance with the second variant is produced as previously in the case of the extrusion and vulcanization of the sheath and of fixing by vulcanization of the other inserts.

It is self-evident that the invention is not limited to the examples which have been given thereof by way of illustration, but comprises all variants which resume the general definition of the invention as claimed in the appended claims. In particular, the semi-conductor materials mentioned firstly for the protective sheath and the ring and secondly for the bar and the bedding material, have been given as preferential examples, but the list of said materials cannot be interpreted as being limitative.

I claim:

1. In an electric line insulator comprising a high tensile strength bar made of a composite material which comprises inorganic or organic fibers or threads bonded together by a hardening synthetic resin, anchor fittings, the ends of said bar being embedded in said anchor fittings by means of a bedding material which directly surrounds said ends, the improvement wherein:

said bar is a semi-conductor bar, the ends of said bar being embedded in said anchor fittings by means of semi-conductor sealing material constituting said bedding material, and a protective sheath of an insulative elasomeric material being fixed over the entire surface of said bar except for the ends of said bar embedded within said semi-conductor sealing material.

2. The electric line insulator as claimed in claim 1, wherein said semi-conductor bar is composed at least in part of conductive carbon fibers with high resistance to traction, impregnated with a resin selected from the group consisting of epoxy and polyester.

3. The electric line insulator as claimed in claim 1 or claim 2, wherein the semi-conductor sealing material is an insulation material charged with high structure carbon black, the high structure carbon black providing excellent electric contact between said bar and said anchor fittings.

* * * * *